US009566462B2

(12) United States Patent
Schwartz

(10) Patent No.: US 9,566,462 B2
(45) Date of Patent: Feb. 14, 2017

(54) PADDED POLE VAULT PLANT BOX

(71) Applicant: UCS, INC., Lincolnton, NC (US)

(72) Inventor: Jeffrey Schwartz, Alpine, NJ (US)

(73) Assignee: UCS, INC., Lincolnton, NC (US)

( * ) Notice: Subject to any disclaimer, the term of this patent is extended or adjusted under 35 U.S.C. 154(b) by 237 days.

(21) Appl. No.: 14/081,458

(22) Filed: Nov. 15, 2013

(65) Prior Publication Data

US 2014/0135177 A1 May 15, 2014

Related U.S. Application Data

(60) Provisional application No. 61/796,595, filed on Nov. 15, 2012.

(51) Int. Cl.

| | |
|---|---|
| ***A63B 21/00*** | (2006.01) |
| ***A63B 5/06*** | (2006.01) |
| ***A63B 71/00*** | (2006.01) |
| *A63B 6/02* | (2006.01) |

(52) U.S. Cl.

CPC ..... *A63B 5/06* (2013.01); *A63B 71/0054* (2013.01); *A63B 6/02* (2013.01); *A63B 2071/0063* (2013.01); *A63B 2209/10* (2013.01)

(58) Field of Classification Search

CPC ..... A63B 21/00
USPC ..... 482/14, 15, 19
See application file for complete search history.

(56) References Cited

U.S. PATENT DOCUMENTS

| | | | |
|---|---|---|---|
| 2,110,254 | A | 3/1938 | Austin |
| 3,075,765 | A | 1/1963 | Mpakarakes |
| 3,948,514 | A | 4/1976 | Von Holt |
| 3,965,507 | A | 6/1976 | Reiland |
| 4,163,551 | A | 8/1979 | Simpson |
| 4,245,838 | A | 1/1981 | Gordon |
| 4,351,413 | A | 9/1982 | Simon |
| 4,443,009 | A | 4/1984 | Smith |
| 7,736,274 | B2 | 6/2010 | Thibodeaux, Sr. |
| 8,444,531 | B1 | 5/2013 | Johnson et al. |
| 2004/0053747 | A1 | 3/2004 | Bollinger |

(Continued)

FOREIGN PATENT DOCUMENTS

| | | | |
|---|---|---|---|
| DE | 9306068.8 | U1 | 10/1993 |
| FR | 2594343 | A1 | 8/1987 |

(Continued)

OTHER PUBLICATIONS

International Preliminary Report on Patentabiliyu (IPRP) for PCT/US2013/070143 completed and mailed on Feb. 11, 2015.

(Continued)

*Primary Examiner* — Jerome W Donnelly
(74) *Attorney, Agent, or Firm* — Moore & Van Allen PLLC; W. Kevin Ransom

(57) ABSTRACT

Embodiments of the invention are directed to an assembly for engaging an end of a vaulting pole, wherein the assembly comprises a base section comprised of a frame configured to be at least partially recessedly installed in the ground. A platform is connected to the base and comprises a top surface comprising a planar surface configured to enable receipt of an end of a vaulting pole during a pole vault plant and at least one padding tray adjacent to a perimeter of the planar surface, which is configured to receive padding. Optionally, a collar of additional padding may be provided comprising at least one padding, wherein the collar is configured for operative coupling to the top surface of the platform.

30 Claims, 11 Drawing Sheets

(56) References Cited

U.S. PATENT DOCUMENTS

| | | | |
|---|---|---|---|
| 2004/0067820 | A1 | 4/2004 | Noble et al. |
| 2014/0135177 | A1 | 5/2014 | Schwartz |
| 2015/0080185 | A1 | 3/2015 | Johnson |

FOREIGN PATENT DOCUMENTS

| | | | |
|---|---|---|---|
| GB | 923243 | A1 | 4/1963 |
| JP | H10 179792 | A | 7/1998 |
| JP | H10 179792 | A | 6/2015 |

OTHER PUBLICATIONS

International Search Report and Written Opinion for PCT/US2013/070143, dated Feb. 19, 2014.
Second Written Opinion for PCT/US2013/070143, dated Oct. 29, 2014.
International Preliminary Report on Patentability (IPRP) for PCT/US2013/070143 completed and mailed on Feb. 11, 2015.
International Search Report and Written Opinion for PCT/US2015/026002, completed Jun. 30, 2015.
Vault Box Collar, Gill Athletics, Inc., Champaign, Illinois, 61822. Retrieved from Internet URL: www.gillathletics.com/store/products.aspx?id=676 on Aug. 19, 2010.

PADDED POLE VAULT PLANT BOX

CROSS-REFERENCE TO RELATED APPLICATION

This application claims priority to U.S. Provisional Application No. 61/796,595, filed Nov. 15, 2012, and entitled Vault Box, the content of which is hereby incorporated herein by reference.

TECHNICAL FIELD

A pole vault plant box with frame configured to receive padding is disclosed.

BACKGROUND

There is a need to protect an athlete from injury when the athlete undertakes a pole vault jump. Most current vault boxes do not provide proper padding to mitigate potential injury.

BRIEF SUMMARY

In one aspect, the present invention is directed to an assembly for engaging an end of a vaulting pole. The assembly comprising a base section comprised of a frame configured to be at least partially positioned below ground level. The assembly further comprises a platform comprising a top surface. The top surface has a planar surface configured to enable receipt of an end of a vaulting pole during a pole vault plant. The top surface also has at least one padding tray adjacent to a perimeter of the planar surface, wherein the padding tray is configured to receive a padding. When installed, a bottom surface of the platform is operatively coupled to the base section. Optionally, the assembly may include a collar of additional padding comprising at least one padding, wherein the collar is configured for operative coupling to the top surface of the platform.

In one embodiment, the platform defines front and rear sides connected by right and left sides so as to form a platform perimeter. At least one padding tray is defined within the platform perimeter and comprises two side padding trays and a rear padding tray. The side and rear padding trays are recessed in respect to a top surface of the platform perimeter and are configured to receive at least one padding.

The planar surface is generally angled in embodiments to receive the end of the pole vault. In particular, the planar surface has a first end adjacent a front side of the platform and extends downwardly at an angle from the front side of the platform perimeter toward the rear side of the platform perimeter and has sides that are spaced apart from said right and left sides of the platform perimeter.

In some embodiments, the platform may comprise at least one side wall having an end connected to the planar surface and angled relative to the planar surface and extending upwardly and outwardly therefrom at an angle towards at least one of the sides of the platform. The side wall is connected between the planar surface and one of the side padding trays. The platform may further comprise a rear wall having an end connected to a second end of the planar surface, whereby the rear wall extends upwardly and outwardly at an angle in respect to the second end of the planar surface and toward the rear side of the platform. The rear wall is connected to the end of the planar surface and the rear padding tray. In some embodiments, the rear wall extends for an extending portion above the top of the side wall such that the rear padding tray is offset vertically above at least one of the side padding trays.

Located in the padding trays is padding. Where the platform comprises individual side and rear padding trays, individual padding may be provided for each tray. Where the padding trays are all of uniform depth, the padding for each tray will have a uniform depth. In instances where the rear padding tray is elevated above the side trays, the padding for the side trays may be thicker so as to provide a uniform, level, flush surface across the top of all of the padding.

As mentioned, the platform is connected to a base section. In one embodiment, the base section comprises a lower section having front and rear ends connected by right and left sides and at least one offset tab located on each of the right and left sides of that lower section that extend upwardly from a top surface of the lower section. The offset tabs are configured for operatively coupling to the platform. In some embodiments, the offset tabs are sized to accommodate the downward angling planar surface of the platform. Specifically, the planar surface extends at a downward angle toward the base. To provide clearance between the end of the planar surface and the ground below the base, the offset tabs are configured to have a height so that the planar surface extends downwardly between them and into the center of the base but is above a bottom surface of the base.

As mentioned, padding is typically provided in the padding trays to avoid or prevent injury to a pole vaulter that may fall on the pole vault box assembly. The pads may be attached by coupling means, such as at least one of a pin, a screw, an adhesive, Velcro, a lock, a tab, and a compressing pin. In some embodiments, the pads have inner surfaces that match the angles of the side and rear walls. For example, in one embodiment, the padding in the side trays may include one inner, side surface adjacent to a respective side wall of the platform that has a beveled or angled edge defining an angle that matches the angle of the respective side wall so as to not interfere with standard pole vaulting operations. Likewise, the rear padding may include an inner side surface adjacent to the rear wall of the platform that is angled or beveled thereby defining an angle that matches the angle of the rear wall so as to not interfere with standard pole vaulting operations.

The padding and platform are configured in one embodiment, such that upon installation, a top surface of the padding is flush with ground level. Where there is a surrounding landing pad, the padding of the assembly is configured so that the landing pad overlaps the padding of the assembly.

As mentioned, in some embodiments, an optional collar is provided. The collar of additional padding is placed substantially on top of the padding, wherein the collar of additional padding is configured to couple with the platform via at least one of a pin, Velcro, a lock, a compressing pin, a tab, an adhesive, and a screw. As installed, a top surface of the collar is substantially flush with a top surface of an adjacent landing pad. In some embodiments, the collar includes an inner surface that is angled or beveled to match with the angle of the side and/or rear walls of the platform.

BRIEF DESCRIPTION OF THE DRAWINGS

Figure 1:
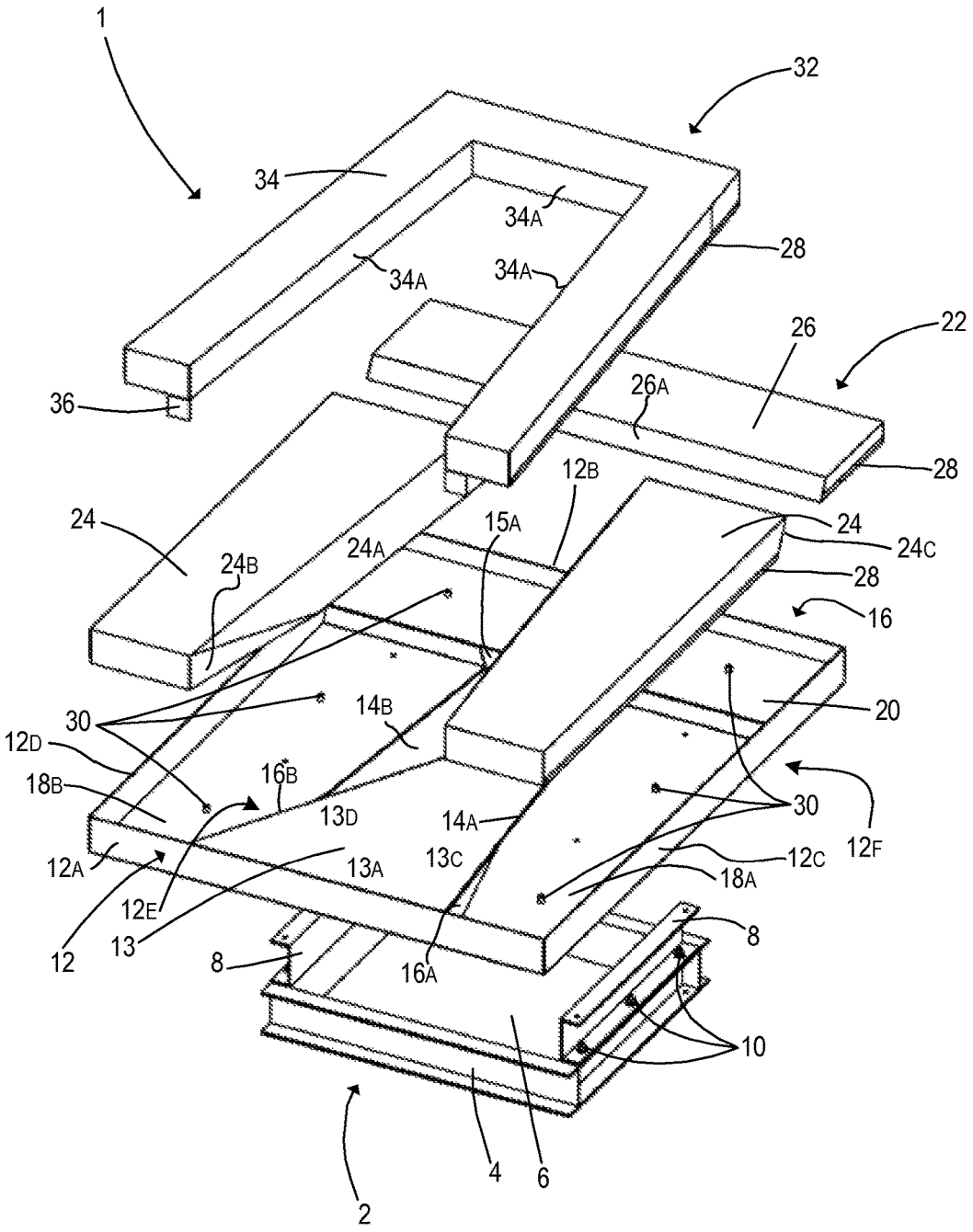
Figure 2:
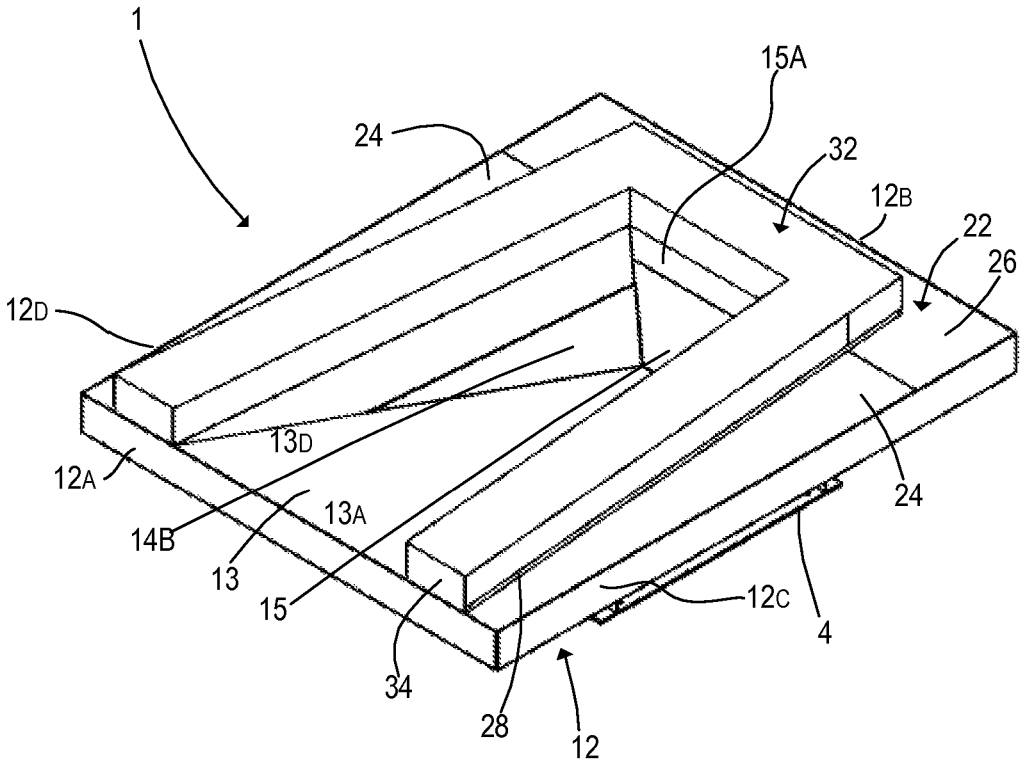
Figure 3:
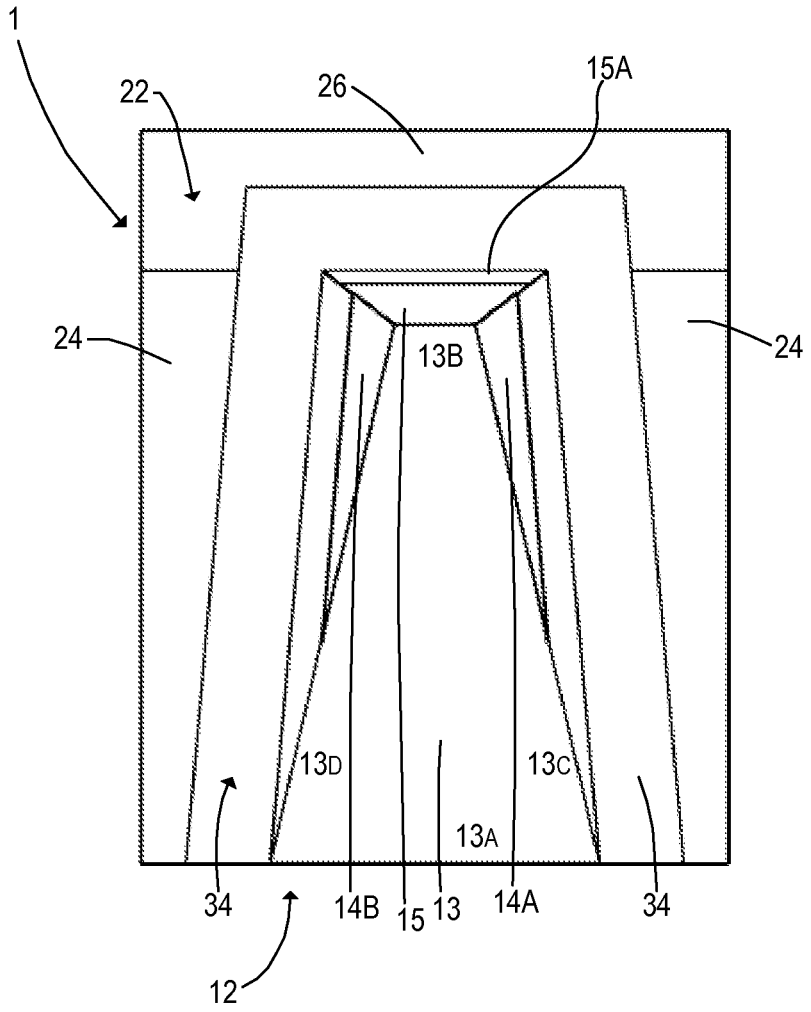
Figure 4:
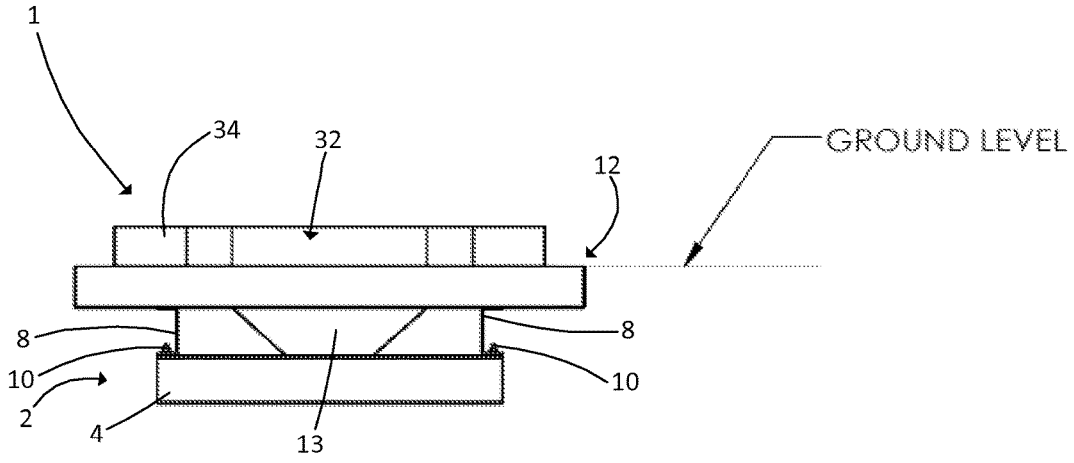
Figure 5:
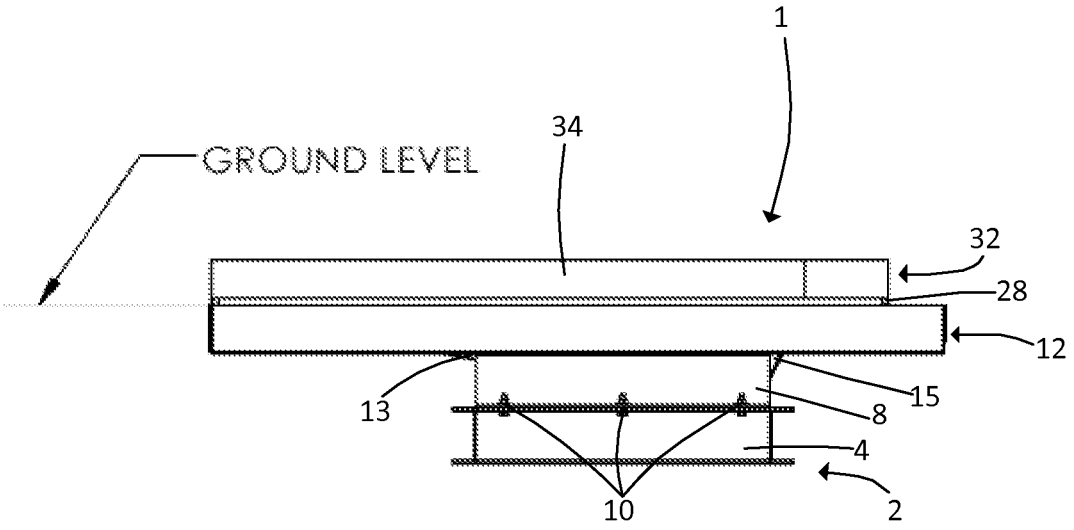
Figure 6:
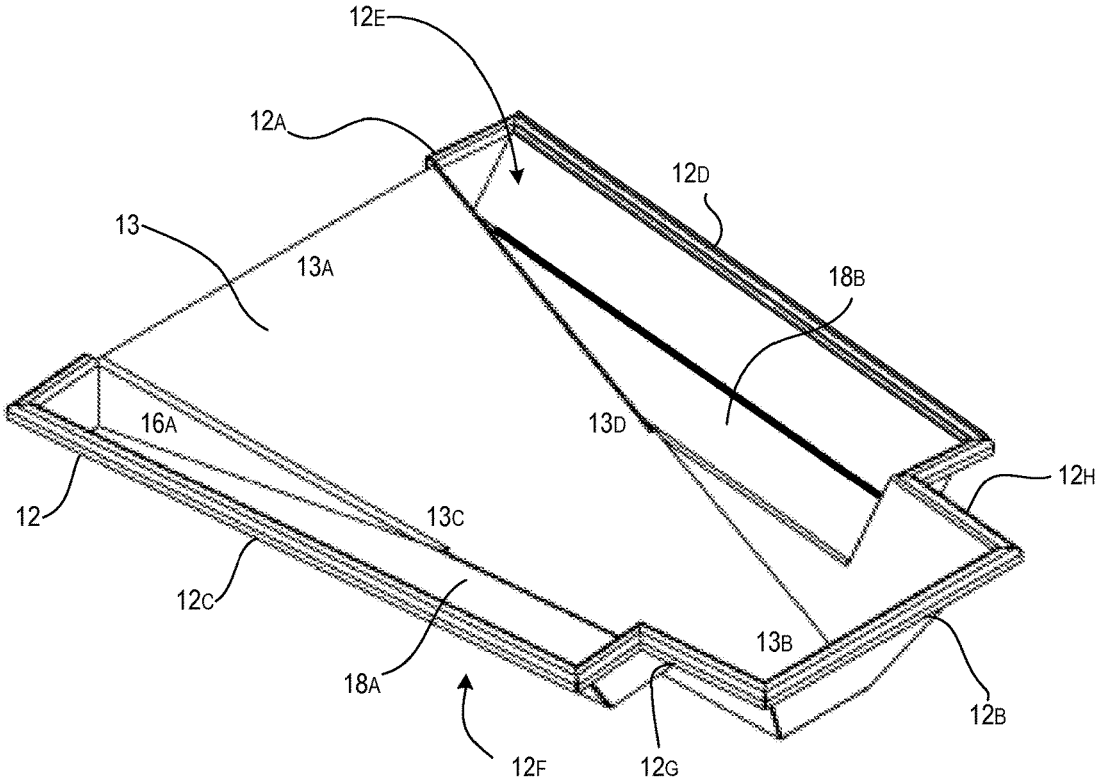
Figure 7:
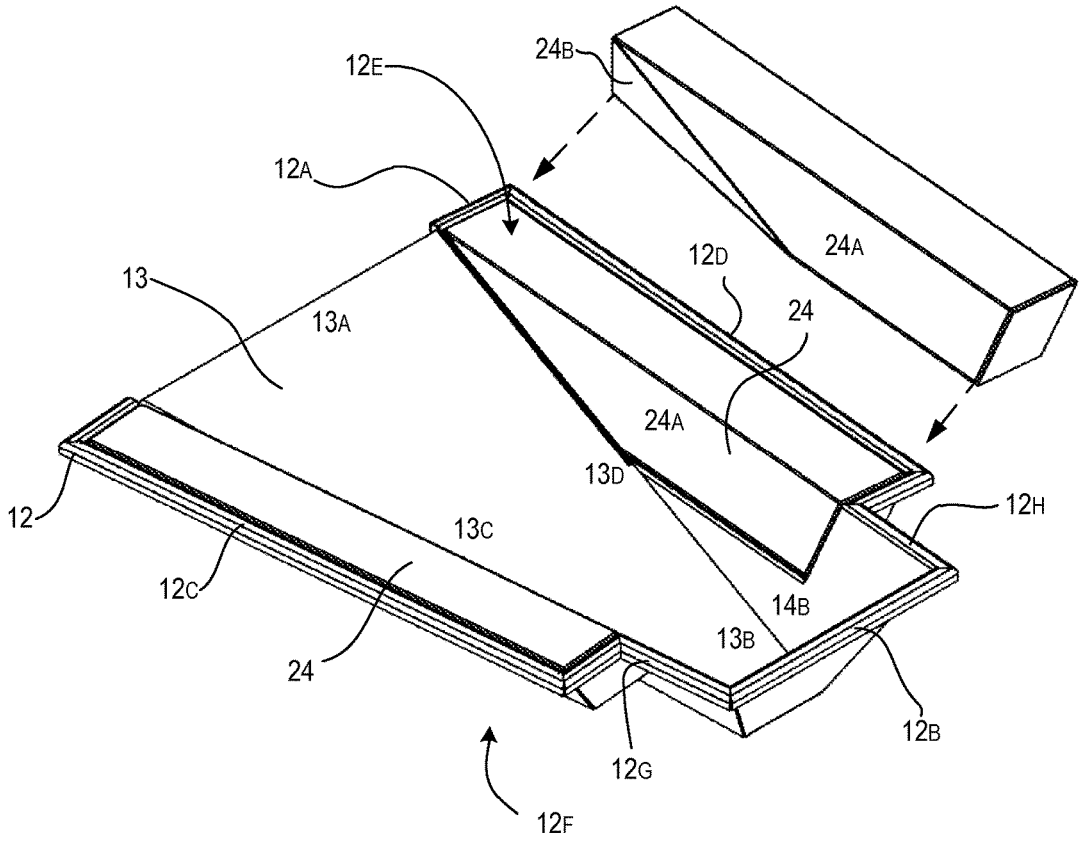
Figure 8:
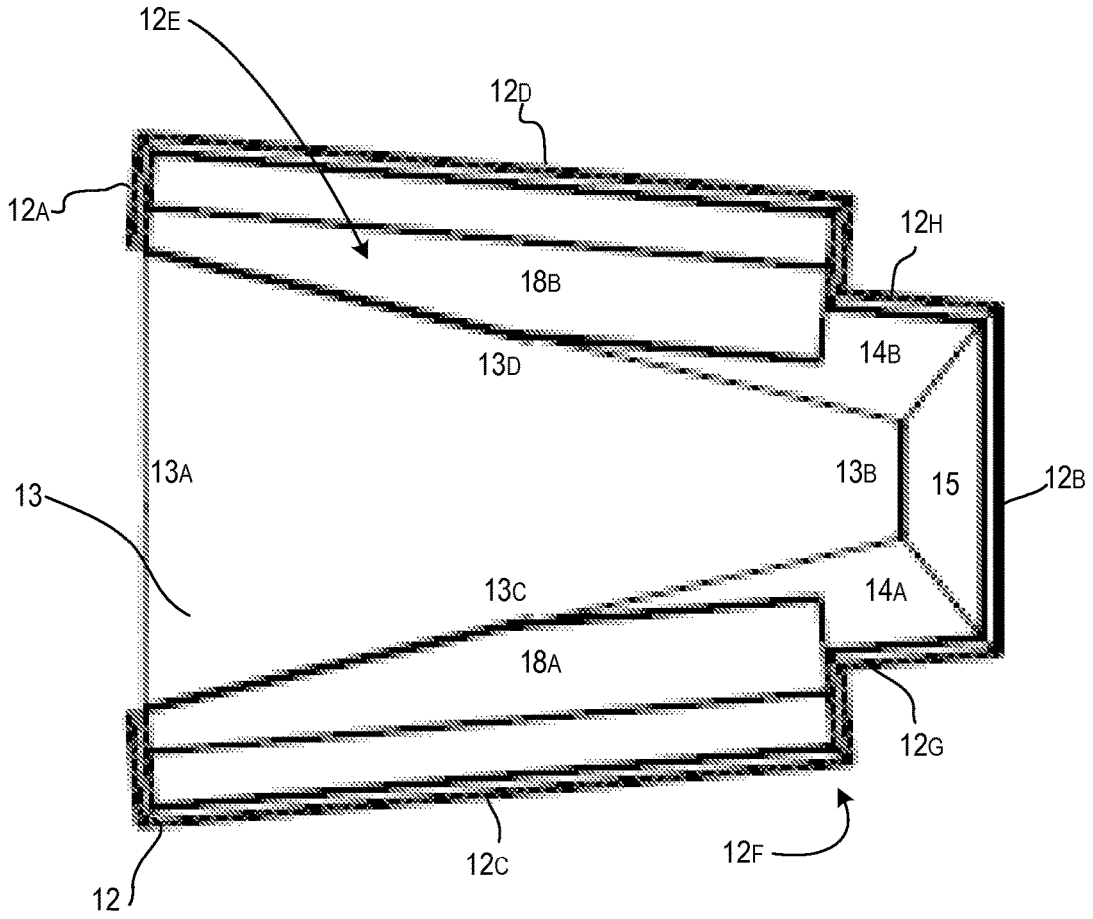
Figure 9:
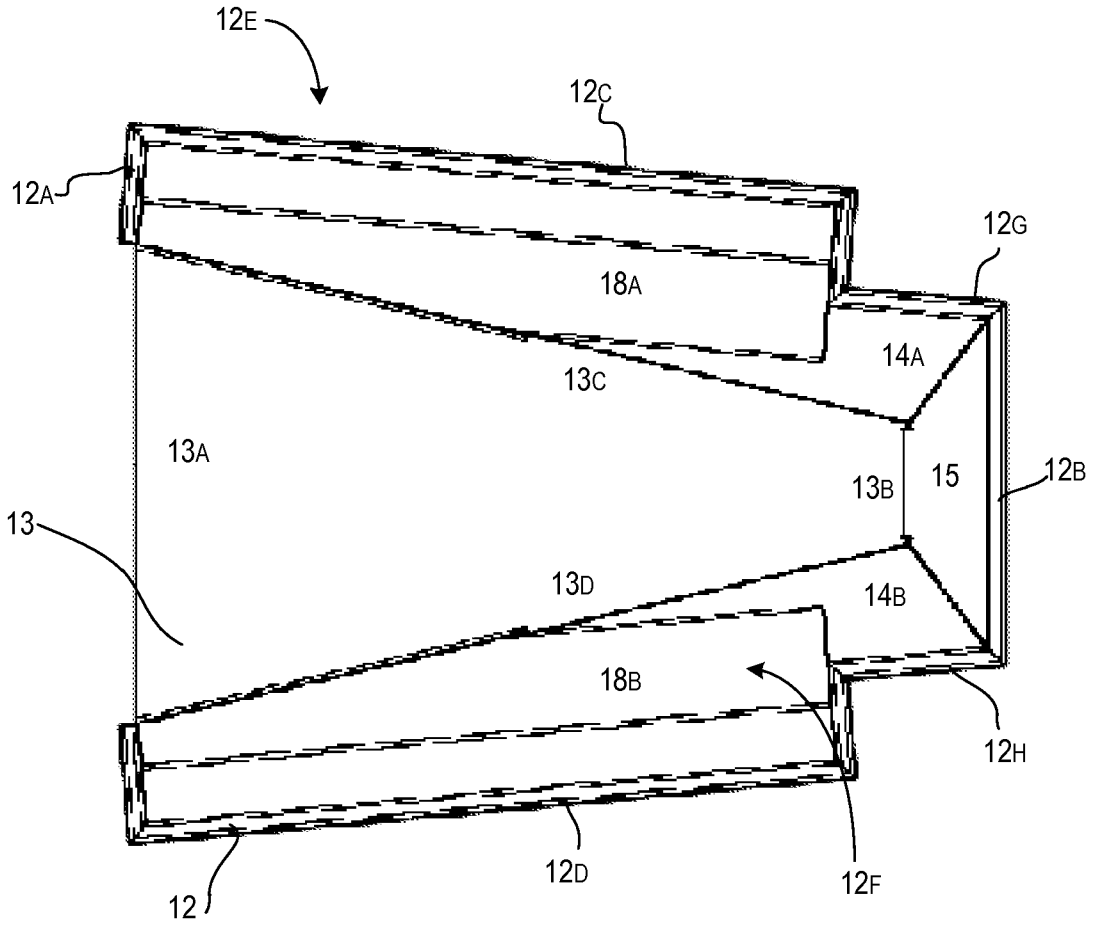
Figure 10:
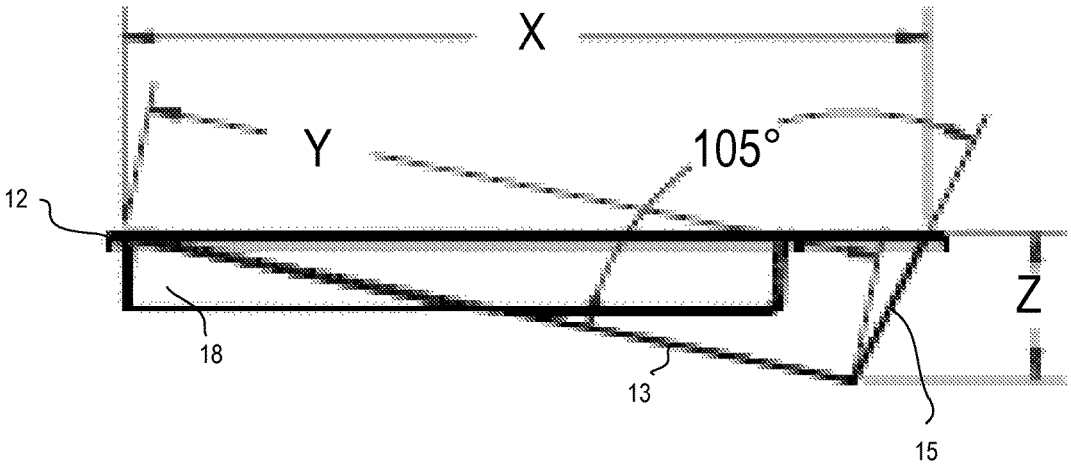
Figure 11:
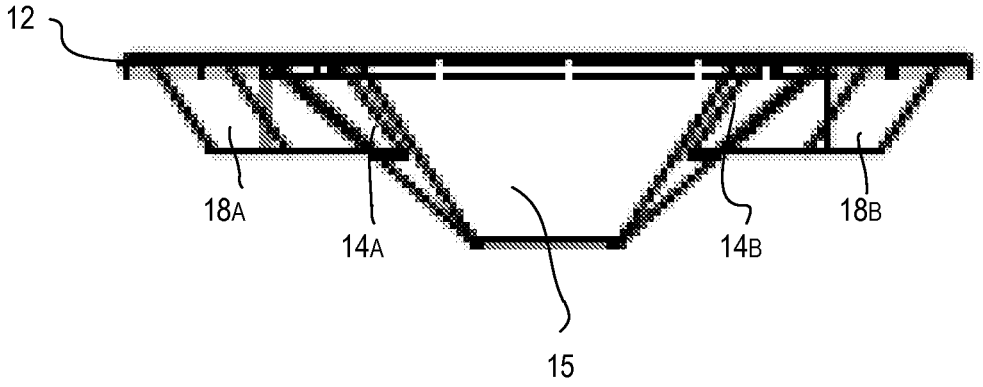

Having thus described embodiments of the invention in general terms, reference will now be made to the accompanying drawings, where:

FIG. 1 depicts an exploded perspective illustration of a pole vault plant box assembly, in accordance with an embodiment of the present invention;

FIG. 2 depicts a right side, perspective view of the pole vault plant box assembly of FIG. 1 as assembled;

FIG. 3 depicts a top side view of the pole vault plant box assembly of FIG. 1 as assembled;

FIG. 4 depicts a front side view of the pole vault plant box assembly of FIG. 1 as assembled;

FIG. 5 depicts a right side view of the pole vault plant box assembly of FIG. 1 as assembled;

FIG. 6 depicts a perspective illustration of a pole vault plant box platform, in accordance with an embodiment of the present invention;

FIG. 7 depicts a right side, perspective view of the pole vault plant box platform of FIG. 6 as assembled with padding;

FIG. 8 depicts a top side view of the pole vault plant box platform of FIG. 6;

FIG. 9 depicts a bottom side view of the pole vault plant box platform of FIG. 6;

FIG. 10 depicts a right side view of the pole vault plant box platform of FIG. 6; and FIG. 11 depicts a rear side view of the pole vault plant box platform of FIG. 6.

DETAILED DESCRIPTION OF EMBODIMENTS OF THE INVENTION

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

When an athlete undertakes a pole vault jump, he/she plants one end of a vaulting pole into a pole vault plant box while holding on to the opposite end of the vaulting pole. The vaulting pole, bending under force, catapults the athlete upwards into the air and over a horizontal bar, which, based on its height above ground, measures the height of the jump. After clearing the bar, the athlete lands safely on a soft landing pad located on an opposite side of the bar from that of the vault box. The landing pad includes padding to cushion the athlete's fall and therefore minimize injury. The landing pad is sized to align with the vaulter as they clear the horizontal bar. However, the landing pad may not be designed to protect the vaulter, if the vaulter falls short of the horizontal bar or experiences issues once the vaulter has engaged the vault box. Added security features are needed to address this issue.

With reference to FIG. 1, the present invention relates to a pole vault plant box assembly 1 that is configured for engaging an end of a vaulting pole during the pole vault process. The pole vault plant box assembly 1 comprises, in general, two sections: 1) a platform 12 and 2) a base section 2. The platform 12 is configured for engaging an end of a pole vault inserted by a vaulter during the pole vaulting process, and the base section 2 is provided for anchoring the platform 12 to the ground or other rigid surfaces. A layer of protective padding 22 is provided around the vaulting pole's planting surface so that an athlete's fall may be appropriately cushioned. The layer of protective padding 22 is generally positioned adjacent to at least a portion of the top surface 12*e* of the platform 12 of the pole vault plant box assembly 1. Optionally, a collar of additional padding 32 may be provided for enabling the assembly 1 to interface with a variety of existing pole vaulting landing pads, thus ensuring adherence to both domestic and international pole vaulting regulations of the IAAF, NCAA, and other governing organizations. Similarly, the optional collar of additional padding 32 may be positioned adjacent to the top surface of the layer of protective padding 22 such that when completely assembled the pole vault plant box assembly 1 may consist of, from top to bottom, respectively, an optional collar of additional padding 32, a layer of protective padding 22, a platform 12, and a base section 2.

The platform 12 of the pole vault plant box assembly may be constructed of bent and welded sheet metal, metal casting, a metal alloy, titanium, aluminum, steel, iron, plastic, fiberglass, carbon fiber, a composite, or another rigid material. The platform 12 defines front, rear, left, and right sides (12*a*-12*d*, respectively) wherein the front 12*a* and rear 12*b* sides are connected by the right 12*c* and left 12*d* sides so as to form a perimeter. In one embodiment, the front 12*a*, rear 12*b*, right 12*c*, and left 12*d* sides are adjoined at their ends to form four (4) 90 degree angles such that the perimeter of the platform forms a square or rectangular shape. For example, in the embodiment illustrated in FIG. 1, a first end of the front side 12*a* is adjoined to a second end of the left side 12*d* at a 90 degree angle to form one (1) of four (4) corners of the perimeter of the platform 12.

Additionally, top 12*e* and bottom 12*f* surfaces are defined within the perimeter. A portion of the top surface 12*e* of the platform 12 defines a planar surface 13 that slopes substantially downward below ground level as depicted in FIGS. 4 and 5. The planar surface 13, is configured to receive the end of an athlete's vaulting pole and slopes downwardly, at an acute angle with respect to ground level, from the front side 12*a* of the platform 12 to the rear side 12*b* of the platform 12. Specifically, the planar surface has a first end 13*a* adjacent to the top edge of the middle portion of the front side 12*a* of the platform, and the planar surface 13 extends downwardly at an angle relative to the top surface 12*e* of the platform toward the rear end 12*b* of the platform 12. In some embodiments, the planar surface 13 may extend from the front 12*a* at a downward angle to a depth of approximately 8.25 inches below the top surface 12*e* of the platform; it being understood, however, that any desired angle and depth can be used based on the requirements of any pole vaulting regulations. As shown in the illustrated embodiments, the planar surface 13 may consist of a first and second end (13*a*, 13*b*) and a left and right side (13*c*, 13*d*) wherein the length of the first end 13*a* is substantially greater than the length of the second end 13*b* such that when adjoined by the right and left sides (13*c*, 13*d*) the planar surface 13 forms a trapezoidal shape, and wherein the second end 13*b* and at least a portion of the right and left sides (13*c*, 13*d*) of the planar surface 13 are positioned below ground level. In one embodiment, the length of the first end 13*a* may additionally define a distance by which the front sides of the side padding 24 of the layer of protective padding 22 are separated.

Extending upward from the rear of the right and left sides (13*c*, 13*d*) of the planar surface 13 are respective right 14*a* and left 14*b* side walls. Extending from the rear end of the planar surface 13 is a rear wall 15. Side walls 14*a* and 14*b* extend upwardly and outwardly from the rear of the sides of the planar surface 13, at an angle greater than or equal to 90 degrees with respect to the sides (13*c*, 13*d*) of the planar surface 13, and towards the right 12*c* and left 12*d* sides, respectively, of the platform 12. The rear wall 15 extends upwardly and outwardly at an angle, with respect to the planar surface 13, from the second end 13*b* of the planar surface 13 and towards the rear end 12*b* of the platform 12.

In one embodiment, the rear edges of the right 14*a* and left 14*b* side walls may be adjacent to the rear wall 15 and separated by a distance equivalent to the length of the second end of the planar surface 13*b*, and the front portion of the right 14*a* and left 14*b* side walls may intersect with a distal point located along the right and left sides (13*c*, 13*d* respectively), of the planar surface 13 such that the right 14*a* and left 14*b* side walls form a triangular shape wherein the intersection between the front portion of the side walls (14*a*, 14*b*) and the distal points located along the right and left sides (13*c*, 13*d*) of the planar surface 13 may define a single vertices' of the triangular shape and form an acute angle extending upwardly with respect to the planar surface 13. The angle at which the side walls 14*a* and rear wall 15 extend upwardly relative to the planar surface 13 may be in compliance with standard pole vaulting rules and regulations or at any desired angled to accommodate at the end of a pole vault and sufficiently retain the pole during a vaulting procedure. For example, the side walls 14*a* and 14*b* are typically at an angle in the range of 30 to 45 degrees with respect to the planar surface, and the rear wall 15 is at angle in the range of 100 to 105 degrees with respect to the planar surface 13. As illustrated in FIG. 11, the platform 12 may comprise set dimensions for the length of the platform 12, the length of the planar surface 13, and the depth of the planar surface (X, Y, Z respectively) such that the rear wall 15 is at angle in the range of 105 degrees with respect to the planar surface 13.

As illustrated in FIGS. 1-3, in some embodiments forward angled side walls 16*a* and 16*b* are located proximate to the first end 13*a* of the planar surface 13. The forward angled side walls 16*a* and 16*b* extend downwardly and outwardly from the planar surface 13, at an angle with respect to the planar surface 13, and towards, respectively, the right 12*c* and left 12*d* sides of the platform 12. In addition to being angled vertically, in some embodiments, the forward angled side walls 16*a* and 16*b* also are angled relative to the front 12*a* and rear 12*b* sides of the platform. The forward angled side walls 16*a* and 16*b* angle inwardly from a position proximate the front 12*a* side of the platform 12 toward the center of the platform 12 and toward the planar surface 13. In one embodiment, the front sides of the right 16*a* and left 16*b* side walls may be adjacent to the front side 12*a* of the platform 12 and separated by a distance equivalent to the length of the first end of the planar surface 13*a*, and the rear portion of the right 16*a* and left 16*b* side walls may intersect with a distal point located along the right and left sides (13*c*, 13*d* respectively), of the planar surface 13 such the right 16*a* and left 16*b* side walls form a triangular shape wherein the intersection between the rear portion of the side walls (16*a*, 16*b*) and the distal points located along the right and left sides (13*c*, 13*d*) of the planar surface 13 may define a single vertices' of the triangular shape and form an acute angle extending upwardly with respect to the padding trays (18*a*, 18*b*). The forward angled side walls 16*a* and 16*b* of the platform 12 form essentially and eased opening at the front of the platform to ensure that the end of the pole is directed to the planar surface 13 and the rear wall 15.

Positioned above the side walls 14*a* and 14*b* and the rear wall 15 of the platform 12 is a padding tray. The padding tray is formed in the top surface 12*e* of the platform 12 and may be stamped, cast, or formed via another method. The left side wall 14*b* extends from the left side edge of the planar surface 13*d* to an inner edge of a left-side padding tray 18*b*, the right side 14*a* extends from a ride side edge of the planar surface 13 to an inner edge of a right-side padding tray 18*a*, and the rear wall 15 extends from the second end of the planar surface 13*b* to an inner edge of a rear padding tray 20. While illustrated in the figures as three separate padding trays (18*a*, 18*b*, and 20), the padding tray may embody one continuous padding tray or any other number of separate padding trays. In one embodiment, as depicted in FIG. 1, the padding tray may include multiple trays such as left- and right-side padding trays 18 and a rear padding tray 20. The padding tray may be of any shape. In the depicted embodiment, the left- and right-side padding trays are trapezoid in shape and the rear tray is rectangular.

The side padding (18*a*, 18*b*) and rear 20 padding trays typically have flat top surfaces defined within the perimeter of the top surface 12*e* of the platform 12. In some embodiments, the flat top surfaces of the padding trays (18*a*, 18*b*, and 20) are positioned parallel to the ground level, and in other embodiments, the flat top surfaces of the padding trays (18*a*, 18*b*, and 20) are positioned at an angle with respect to the ground level. These padding trays are typically configured to receive padding 22 and may form a recess with respect to the top surface 12*e* and perimeter (12*a*-12*d*) of the platform 12. Right and left side padding trays 18*a* and 18*b* may be configured to receive right and left side padding 24, respectively, wherein the right and left side padding 24 may be positioned adjacent to the top surface of the padding trays (18*a*, 18*b*) such that at least a portion of the right and left padding 24 completely fills the recess formed by the side padding trays (18*a*, 18*b* respectively). Likewise, the rear padding tray 20 may be configured to receive rear padding 26, wherein the rear padding 26 may be positioned adjacent to the top surface of the rear padding tray 20 such that at least a portion of the rear padding 26 completely fills the recess formed by the side padding trays (18*a*, 18*b*). Other configurations of padding may include one continuous pad, or another number of separate padding units.

In some embodiments, as illustrated in FIGS. 6-11, the rear padding tray 20 and rear padding 26 may be omitted from the pole vault plant box assembly 1. In such an embodiment, the plant box assembly 1 may consist of only the side padding trays (18*a*, 18*b*) and side padding 22, and the platform 12 may instead define a front 12*a*, rear 12*b*, right straight-edged 12*c*, right angled 12*g*, left straight-edged 12*d*, and left angled 12*h* side wherein the front 12*a* and rear 12*b* sides are connected by the straight-edged and angled sides adjoined to one another so as to form a perimeter. Specifically, the right and left edges of the front side 12*a* are connected to the right 12*c* and left 12*d* straight-edged sides, the right 12*d* and left 12*c* straight-edged sides are connected to the base of the right 12*g* and left 12*h* angled sides, and the right 12*g* and left 12*h* angled sides are connected to the rear 12*b* side wherein the angle of the angled sides (12*g*, 12*h*) are positioned outwardly with respect to the planar surface 13. In an exemplary embodiment, the angled sides (12*g*, 12*h*) may be defined by a 90 degree angle such that the angled sides form an "L-shape". In such an embodiment, the side walls (14*a*, 14*b*) may extend beyond the padding trays (13*a*, 18*b*) towards the rear side 13*b* of the planar surface 12 and upwardly towards the top surface of the angled sides (12*g*, 12*h*) of the perimeter of the platform 12 such that the top edge of the sides walls (14*a*, 14*b*) are flush with the layer of padding 22. Additionally, in such an embodiment, the rear wall 15 may not extend above the top of the side walls (14*a*, 14*b*) such that the top edges of the rear wall 15 and side walls (14*a*, 14*b*) are flush with one another.

With reference to FIGS. 1-3, the vault plant box assembly 1 depicted has rear wall 15 that extends at least a portion 15*a* above the side walls 14*a* and 14*b*. This configuration is optional. The extension of the rear wall 15 provides added support to pole vault when it is inserted in the vault box. As illustrated in FIG. 1, the extension 15*a* of the rear wall 15 causes the top surface 20*a* of the rear padding tray 20 to be elevated vertically above the top surfaces of the side padding trays 18*a* and 18*b*. In this embodiment, the side padding 24 in the side padding trays 18*a* and 18*b* may be thicker than the rear padding 26 received by the rear padding tray 20 to maintain a flush upper padding surface for all padding.

Referring again to FIG. 1, the top surfaces of the padding trays (18*a*, 18*b*, and 20) are configured to receive padding 22. To maintain the padding in place, the padding trays may include couplings 36 such as pins, screws, an adhesive, Velcro®, a lock, a tab, a compressed pin, or the like for engaging the padding. The padding 22 is also configured for attachment to the padding trays. In some embodiments, as depicted in FIGS. 1 and 2, bottom surfaces of the padding 22 (e.g., the side padding 24 and the rear padding 26) may include a rigid form 28 that provides structure to the padding 22 as well as a solid surface for coupling the padding 22 to the padding trays. The bottom surface of the padding 22 may be coupled to the padding tray 16 via couplings 30 such as pins, screws, an adhesive, Velcro®, a lock, a tab, a compressed pin, or the like.

In addition to the rigid bottom form 28, the padding 22 may be constructed from foam, molded foam, or cushion and upholstered or skinned with a fabric which will contain the foam in its required shape while providing resistance to damage from impacts of the vaulting pole or the athlete's cleats. Thickness of the padding 22 may range between 3.5 to 4 inches, or may be another thickness. Typically, the top surface of the padding 22 is flush with the top surface of the platform 12, which is typically flush with ground level as depicted in FIGS. 4 and 5.

In general, the side 24 and rear 26 padding is configured to conform to the shape of the respective padding trays (18*a*, 18*b*, and 20). Furthermore, the padding may conform to the angles of the side walls 14*a* and 14*b*, the rear wall 15, and, if provided, the forward angled side walls 16*a* and 16*b*. For example, an inner vertical surface 24*a* of the side padding 24 may be angled to conform with the angle of the respective side walls 14*a* and 14*b*. A separate portion 24*b* of the inner vertical surface of the side padding 24 may be angled to conform with the vertical and horizontal angles of the forward angled side walls 16*a* and 16*b*. Likewise, the rear padding 26 may include an inner vertical surface 26*a* that may be angled to conform with the angle of the rear wall 15. As illustrated in FIG. 1, in this embodiment, a rear surface 24*c* of the side padding 24 may be angled oppositely of the angle of the inner vertical surface 26*a* so that the padding mate.

Referring again to FIG. 1, an optional collar of additional padding 32 may be provided to increase the padded protection of a vaulter during the vaulter's fall towards the ground, thus reducing the risk of an athletic injury. In some embodiments, the collar of additional padding 32 may form and/or substantially resemble a "U-shape" and may be positioned adjacent to at least a portion of the top surface of the layer of protective padding 22 such that the inner edges of the optional collar of additional padding 32 and the inner edges of the layer of protective padding 22 are flush with one another.

Similar to the side padding 24 and the rear padding 26, the bottom surface of the optional collar of additional padding 34 may include a rigid form 28 that that provides supportive structure to the optional collar of additional padding 34 as well as a rigid surface for coupling the optional collar of additional padding 34 to the top surface of the platform 12 or its padding 22. The bottom surface of the optional collar of additional padding 32 may be coupled to the padding 22 via couplings 36 such as pins, screws, an adhesive, Velcro®, a lock, a tab, a compressed pin, or the like. In some embodiments, the collar of additional padding 32 may be detachably or removably coupled to the top surface of the platform 12 or the top surface of the platform's padding 22 so that it may be installed or removed as needed.

In some embodiments, the rear padding tray 20 and rear padding 26 are omitted from the pole vault plant box assembly 1. In such an embodiment, the optional collar of additional padding 32 may be similarly omitted. However, it should be noted that the optional collar of additional padding 32 may still be included in various formations. In one embodiment, the two end sections of the optional collar of additional padding 32 are adjacently positioned above the side padding 22, and the medial section of the optional collar of additional padding 32 is adjacently positioned above the rear 13*b* of the planar surface 13 such that at least a portion of the medial section extends beyond the perimeter of the platform 12 with respect to the angled sides of the platform (12*g*, 12*h*). In an alternate embodiment, two optional sections of additional padding may be provided such that a left and right section of padding are respectively and adjacently positioned above the side padding 22, wherein the optional sections of additional padding may have one or more dimensions of size equivalent to the side padding such that the optional sections of additional padding do not extend beyond the side walls (14*a*, 14*b*), and wherein the rear side 13*b* of the planar surface 13 is uncovered.

As illustrated in FIGS. 1, 2, 4, and 5, the platform 12 is connected to a base section 2, which is used to anchor the platform 12 of the plant box assembly 1 to the ground or other rigid structure. The base section 2 may be manufactured from a rigid material such as a metal, a metal alloy, titanium, aluminum, steel, iron, plastic, fiberglass, carbon fiber, or a composite. The base section 2 includes a substantially rectangular- or square-shaped support frame 4 having front and rear ends and two sides forming a cavity 6 in the center. The support frame 4 may be coupled to and therefore include one or more offset tabs 8 located on the sides of the frame and extending from a top surface thereof. The offset tabs 8 may be operatively coupled to the support frame via couplings 10 such as pins, screws, an adhesive, a lock, a tab, a compressed pin, or the like. Typically positioned on opposite parallel sides of the top surface of the support frame 4, the offset tabs 8 may provide added height to the support frame 4 so that the cavity 6 of the support frame is configured to receive at least part of the platform 12. As illustrated, the planar surface 13 of the platform 12 extends into the cavity 6 of the support frame 4 wherein the planar surface 13 is received between the oppositely positioned offset tabs 8. As such, the offset tabs allow the frame to be positioned at a desired depth in the ground of other rigid structure while providing clearance for the downward angle of the planar surface 13 of the platform 12.

As illustrated in FIGS. 4 and 5, once the base section 2 is properly positioned in the ground, concrete, cement, an epoxy, or another similar adhesive substance may be poured around the base section to ensure a secure and permanent coupling between the base section 2 and the ground. When properly installed, the base section 2 is recessed in the ground such that the base section 2 is below ground level as depicted in FIGS. 4 and 5. The base section 2 may be adjustable in height or depth in the ground. Upon installation, the platform 12 may be recessed into the ground so that the top surface of the platform 12 is flush with ground level as illustrated in FIGS. 4 and 5.

During operation, the pole vault plant box assembly 1 may be operatively adjacent to a landing pad that used by the athlete when landing after undertaking a pole vaulting jump. In some embodiments, the landing pad may be placed adjacent to or on top of the rear padding 26, (or side padding 24, or other padding 22) so that the landing pad 26 substantially overlaps the top surface of the rear padding 26, which is typically flush with ground level. The optional collar of additional padding 32 may be installed such that the top surface of the optional collar of additional padding 32 or the top surface 34 of the optional collar of additional padding 32 may be flush with the top surface of the landing pad. Such a configuration may create a seamless protective landing surface for the athlete, thus reducing potential injuries in the event that the athlete falls in a space between the landing pad 38 and the plant box assembly 1.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

What is claimed is:

1. An assembly for engaging an end of a vaulting pole, said assembly comprising:

a base section having a frame for at least partial recess in the ground;

a platform having a top surface, where the top surface has a planar surface structured to receive an end of a vaulting pole during a pole vault plant;

at least one padding tray adjacent to a perimeter of said planar surface, wherein said padding tray is recessed to receive a padding; and a bottom surface of said platform operatively coupled to said base section; and a collar section having at least one padding, wherein said collar is structured to couple to the top surface of said platform.

2. The assembly of claim 1, wherein said platform defines front and rear sides connected by right and left sides so as to form a platform perimeter, wherein said at least one padding tray is defined within said platform perimeter, wherein said at least one padding tray has two side padding trays and a rear padding tray, wherein said side and rear padding trays are recessed in respect to a top surface of said platform perimeter for receiving at least one padding.

3. The assembly of claim 2, wherein said planar surface has a first end adjacent a front side of said platform, wherein said planar surface extends downwardly at an angle from said front side of said platform perimeter toward said rear side of said platform perimeter, wherein said planar surface has sides that are spaced apart from said right and left sides of said platform perimeter.

4. The assembly of claim 3, wherein said platform has at least one side wall having an end connected to said planar surface, said side wall angled relative to said planar surface and extending upwardly and outwardly therefrom at an angle with respect to said planar surface from said planar surface and towards at least one of said sides of said platform and connected to one of said side padding trays.

5. The assembly of claim 4, wherein said platform has a rear wall having an end connected to a second end of said planar surface, said rear wall extending upwardly and outwardly at an angle in respect to the second end of said planar surface and towards said rear side of said platform and connected to said rear padding tray.

6. The assembly of claim 5, wherein said rear wall extends for an extending portion above the top of said side wall.

7. The assembly of claim 6, wherein said rear padding tray is offset vertically above said at least one side padding tray.

8. The assembly of claim 7 further having side padding located in said side padding trays and rear padding in said rear padding tray, wherein said side paddings are thicker than said rear padding so that top surfaces of said side padding and said rear padding are substantially flush with each other when installed in said platform.

9. The assembly of claim 2 further having padding located in said side padding trays and rear padding tray, wherein said padding has one congruent padding.

10. The assembly of claim 1, wherein said base section has:

a lower section having front and rear ends connected by front and left sides; and at least one offset tab located on each of said first and left sides of said lower section and extending upwardly from a top surface of said lower section for coupling to said platform.

11. The assembly of claim 10, wherein said planar surface extends at a downward angle, wherein offset tabs have a height so that the planar surface extends downwardly between them.

12. The assembly of claim 1, wherein said planar surface is angled downward to a depth of 8.25 inches below a horizontal plane defined from said first end of said planar surface.

13. The assembly of claim 1, wherein said padding tray includes means for coupling padding to said padding tray, wherein said means for coupling is at least one of a pin, a screw, an adhesive, Velcro, a lock, a tab, and a compressing pin.

14. The assembly of claim 4 further having padding located in said side padding trays, wherein said padding defines at least one side surface adjacent to a respective side wall of said platform, wherein said side surface has a beveled edge defining an angle that matches the angle of said respective side wall so as to not interfere with standard pole vaulting operations.

15. The assembly of claim 5 further having padding located in said rear padding tray, wherein said padding defines at least one side surface adjacent to said rear of said platform, wherein said side surface has a beveled edge defining an angle that matches the angle of said rear wall so as to not interfere with standard pole vaulting operations.

16. The assembly of claim 1 further having padding located in said padding tray, wherein upon installation a top surface of said padding is flush with ground level, wherein said padding includes at least one of side padding and rear padding.

17. The assembly of claim 2, wherein at least one of said side padding and said rear padding include a layer of rigid material on their bottom surfaces so as to the enable the secure coupling of said side padding and said rear padding to said platform, wherein said side padding and said rear padding are coupled to said platform via at least one of a pin, Velcro, a lock, a compressing pin, a tab, an adhesive, and a screw.

18. The assembly of claim 1 further having padding located in said padding tray, wherein said collar section is placed substantially on top of said padding, wherein said collar section is coupled with said platform via at least one of a pin, Velcro, a lock, a compressing pin, a tab, an adhesive, and a screw.

19. The assembly of claim 2 further having an adjacent landing pad, wherein said landing pad, upon installation, substantially overlaps the top surface of said side padding and said rear padding.

20. The assembly of claim 19, wherein upon installation of said collar, a top surface of said collar is substantially flush with a top surface of the adjacent landing pad.

21. The assembly of claim 1, wherein said at least one padding of said collar section defines an inner surface adjacent to said planar surface when installed, wherein said inner surface has a beveled edge defining an angle so as to not interfere with standard pole vaulting operations.

22. An assembly for engaging an end of a vaulting pole, said assembly comprising:

a platform having a top surface having:

a planar surface for receiving an end of a vaulting pole during a pole vault plant; and at least one padding tray adjacent to a perimeter of said planar surface, wherein said padding tray is recessed to receive a padding.

23. The assembly of claim 22 further having a base section with a frame for at least partial recess in the ground, wherein said platform is operatively connected to said frame.

24. The assembly of claim 22 further having a collar section with at least one padding, wherein said collar is structured to couple to the top surface of said platform.

25. The assembly of claim 22, wherein said platform defines front and rear sides connected by right and left sides so as to form a platform perimeter, wherein said at least one padding tray is defined within said platform perimeter, wherein said at least one padding tray has two side trays and a rear tray, wherein said side and rear trays are recessed in respect to the top surface of said platform perimeter and are recessed to receive at least one padding.

26. The assembly of claim 25, wherein said planar surface has a first end adjacent a front side of said platform, wherein said planar surface extends downwardly at an angle from said front side of said platform perimeter toward said rear side of said platform perimeter, wherein said planar surface has sides that are spaced apart from said right and left sides of said platform perimeter.

27. The assembly of claim 26, wherein said platform has at least one side wall having an end connected to said planar surface, said side wall angled relative to said planar surface and extending upwardly and outwardly therefrom at an angle with respect to said planar surface from said planar surface and towards at least one of said sides of said platform and connected to one of said side padding trays.

28. The assembly of claim 27, wherein said platform has a rear wall having an end connected to a second end of said planar surface, said rear wall extending upwardly and outwardly at an angle in respect to the second end of said planar surface and towards said rear side of said platform and connected to said rear padding tray.

29. The assembly of claim 28, wherein said rear wall extends for an extending portion above the top of said side wall.

30. The assembly of claim 23, wherein said base section has:

a lower section having front and rear ends connected by front and left sides; and at least one offset tab located on each of said first and left sides of said lower section and extending upwardly from a top surface of said lower section for coupling to said platform, wherein said planar surface extends a downward angle, and wherein offset tabs have a height so that the planar surface extends downwardly between them.

* * * * *